US006530722B1

(12) United States Patent
Shaw et al.

(10) Patent No.: US 6,530,722 B1
(45) Date of Patent: Mar. 11, 2003

(54) DRAIN SEALING DEVICE

(76) Inventors: Mark D. Shaw, 132 Sea Lily La., Ponte Vedra Beach, FL (US) 32082; J. Tad Heyman, 659 Ocean Blvd., Atlantic Beach, FL (US) 32233; Laurence M. Bierce, 1215 Pine Cir., Macclenney, FL (US) 32063

( * ) Notice: Subject to any disclaimer, the term of this patent is extended or adjusted under 35 U.S.C. 154(b) by 0 days.

(21) Appl. No.: 09/952,737

(22) Filed: Sep. 14, 2001

(51) Int. Cl.[7] ..... A47K 1/14; E02B 1/00

(52) U.S. Cl. ..... 405/52; 404/2; 210/170; 4/293

(58) Field of Search ..... 405/36, 52, 107, 405/109, 270, 115, 40; 404/2, 4; 210/164, 166, 170; 4/286, 293, 295

(56) References Cited

U.S. PATENT DOCUMENTS 1,981,358 A * 11/1934 Hernandez ..... 4/293
3,474,625 A * 10/1969 Draper et al. ..... 405/270
4,371,288 A * 2/1983 Borca et al. ..... 405/53
4,838,732 A 6/1989 Clark et al. ..... 405/52
4,988,234 A 1/1991 Henkel et al. ..... 405/36
5,236,281 A 8/1993 Middleton ..... 405/114
5,394,657 A * 3/1995 Peterson ..... 210/163
5,460,867 A * 10/1995 Magnuson et al. ..... 405/36
6,338,168 B1 * 1/2002 Valentine ..... 4/286

* cited by examiner

*Primary Examiner*—Thomas B. Will
*Assistant Examiner*—Tara L. Mayo
(74) *Attorney, Agent, or Firm*—Thomas C. Saitta

(57) ABSTRACT

A drain seal for rapidly sealing the apertures in a drain grate, the drain seal composed of a mat of polymeric material and having a pair of opposing sealing surfaces and internally disposed reinforcement members to increase structural integrity.

26 Claims, 2 Drawing Sheets

DRAIN SEALING DEVICE

BACKGROUND OF THE INVENTION

This invention relates to devices used to cover or seal storm drain grates or similar apertured drain members when it is desired to prevent liquids from passing through the grates into the drain system. More particularly, the invention relates to such devices which comprise liquid impermeable mats or sheets composed of polymeric materials, where the mats are simply placed onto the top of the grates to close off the openings.

Drainage systems for removing liquids from an area are well known, and may comprise for example storm drain systems for removing rain water from roads and parking lots or interior drain systems provided in the floors of warehouses and other buildings. In many such systems the drain system comprises an interconnected network of pipes or other conduits which receive water flowing through surface mounted drains and deliver the water to a reservoir or tank, or deliver the water to a remote exterior location for release. The drains are usually provided with an apertured grate, such that liquids will freely pass through the grate but large objects will be precluded from entering in order to prevent blockage of the drain system, lost objects and accidental injury. The grates are of many configurations and may be rectangular, square, circular, etc., and the individual openings or apertures in the grates themselves may be of many shapes, such as circular, square, rectangular, etc., as there is no uniform or standard configuration within the industry.

Under certain circumstances it is desirable to quickly seal the drains such that liquid does not pass into the drain system, since in many instances the drain systems simply release liquids into the environment at remote or controlled local locations. For example, it may be necessary to temporarily seal the drains when pollutants or hazardous material spills occur, due for example to tanker truck accidents, pipe or liquid container failures, etc., in order to prevent the hazardous liquid from passing into the drain system and out into the environment. It is known to provide mechanical valves or custom fitted caps which correspond to a particular grate design, but these solutions are not viable in many circumstances, such as with outdoor storm drain systems where various designs of grates may be encountered, and are not particularly suitable in emergency situations where an immediate response is required. It is more practical to have a drain seal which operates in a universal and simple manner, such that a large variety of grates can be quickly and effectively sealed by response personnel without the need to match a particular grate or to undertake excessive, time-consuming connection steps.

To this end drain sealing devices have been developed which comprise in general a sheet or mat composed of a flexible polymeric or elastomeric material, the material being impermeable to liquids and highly chemical resistant, such that the drain can be sealed by placing a mat directly on top of the grate, where the mat's outer dimensions extend beyond the outer edges of the grate. Such sealing devices may be composed of polyurethane, polyvinyl chloride (PVC) silicone or other polymers possessing appropriate properties.

One example of such a sealing device is a drain seal sold commercially under the brand name DRAINBLOCKER by New Pig Corp., which comprises a flexible, two-layer, polyurethane mat having a thin upper structural layer made of polymer joined to a thicker lower sealing layer made of polymer, where the upper structural layer is denser, less elastic, and less flexible than the lower layer. The lower sealing layer is somewhat tacky and is provided with a thin, removable cover layer which is removed prior to use. In use, the soft lower layer conforms and seals against the grate and the surrounding frame, roadway or floor slab such that liquids cannot pass beneath the drain seal and into the drain. The upper structural layer is provided to impart strength and increased rigidity to the lower layer, and to prevent tearing during handling. Such a drain seal suffers from several inherent weaknesses, including the need to provide a removable cover layer to prevent undesirable adhesion to other mats and other objects during storage, and to prevent accumulation of debris, dust, sand and other particulate matter on the soft lower layer prior to use, which cover layer needs to be reapplied to the sealing device after it is cleaned for reuse. Another drawback is the problem of incorrect use of the sealing device, since response personnel may easily invert the device in an emergency response such that the structural layer is mistakenly placed directly against the grate rather than the softer sealing layer, in which case the drain may not be properly sealed. In addition, larger mats of this design are subject to tearing because of the lack of internal structure or reinforcement, such that a small tear in the perimeter rapidly passes through the entire mat during handling.

Another example of a sealing device in the form of a mat is shown in U.S. Pat. No. 4,988,234 issued to Henkel et al. This device is similar to the New Pig device described above and comprises a flexible two-layer mat where the thin upper layer is denser and less elastic than the lower layer. The upper layer is shown to comprise a silicon rubber and the lower layer is described as a molding composition which comprises a highly viscous, sticky, silicone gel. The sealing device must remain sealed in an air-tight package until needed for use. The gel cures from a plastic state into an elastic state when exposed to moisture in the atmosphere, such that when the device is placed onto a grate to prevent liquid passage into the drain system, the lower gel layer freely flows to enter and fill the grate apertures, whereupon it quickly cures to adopt a configuration particular to that grate. Such a sealing device is therefore not reusable and is difficult to handle during emergency situations, since the device must first be removed from the air-tight packaging, and is likewise susceptible to tearing and failure due to the lack of internal reinforcing structure, as well as inversion by inexperienced personnel.

Still another example of a drain sealing device is the sealing mat of U.S. Pat. No. 4,838,732 issued to Clark et al. This device comprises a core elastomer having low shear resistance and high flow characteristics, with the core elastomer being encased in a flexible, thin-film, liquid impermeable envelope, which may be open or sealed on the edges. Drawbacks to this device include the tendency of the flowable core elastomer to bottom out during storage due to gravity effects, such that the core elastomer may be unevenly distributed within the device unless the device is stored in a flat position. Also, since the envelope material contacts the ground and grate surfaces rather than the softer core elastomer, there is less adhesion and a greater likelihood that liquid flowing against the mat will lift the edges of the mat and enter the drain system. As with the other sealing devices described above, there is no reinforcing structure, such that the mat is susceptible to tearing and failure.

It is an object of this invention to address and overcome the problems and drawbacks inherent in the known mat-type drain sealing devices by providing a drain sealing mat device which is composed of polymeric material, where the semi-rigidity of the polymeric material provides a suitable amount of creep or sag such that the mat will conform to the apertures in the grate to be sealed without such creep or sag being excessive, where either side of the mat can be disposed against the grate and surrounding ground supporting surface with equal sealing efficacy due to the provision of internal structural reinforcement members to provide strength and tear resistance. It is a further object to provide such a sealing device where the internal reinforcement member comprises a woven fiberglass scrim, a mesh or fabric material, a flexible fiber reinforced plastic (FRP) screen material or a formable wire screen, and where the internal reinforcement member may also serve to prevent filler materials, which may be added to increase the overall weight of the device, from migrating to the surface of the device over time. It is a further object to provide such a sealing device where the outer surface may be provided with ridges, channels, scallops or other physical structures to increase the sealing efficiency of the device. These objects and other objects not expressly stated will be made evident upon examination of the disclosure which follows.

SUMMARY OF THE INVENTION

The invention is in general a drain sealing device for temporarily blocking and sealing a surface-mounted, apertured drain member disposed, for example, on the ground, in the curb adjacent a paved road, within a parking lot, or in the floor of a structure. Such drain systems are well known, typically comprising a removable, apertured grate member disposed atop a downwardly oriented pipe, conduit or concrete body, such that any liquid entering the drain is conducted from the ingress location through the drain system to a point of disposal or treatment. Storm water drains in roadways and parking lots or liquid removal systems in the floors of warehouses are examples of such drain systems. The sealing device of the invention is a sheet or mat formed of a polymeric material which can be quickly placed over the drain grate with the edges of the mat extending beyond the grate such that all grate apertures are covered by the mat.

The drain sealing device is formed with an internally disposed reinforcement means to provide strength, increase rigidity and improved tear resistance, such that the material forming either side of the device may possess optimum sealing characteristics and such that either side of the sealing device can be disposed downwardly against the grate with equal sealing efficacy. The polymeric material forming the sealing device has a sufficient minimum amount of creep or flexibility such that all of the apertures in the grate are well sealed, yet is sufficiently durable and of suitable hardness for handling purposes. Preferably, the internal reinforcement means comprises a fiberglass scrim, fabric, mesh, FRP screen or wire screen material.

The drain sealing device may be provided with structural sealing members, such as ridges or channels, on one or both sealing surfaces to increase the sealing efficacy between the device and the ground surface or grate. The internal reinforcement means may be centrally disposed or may be disposed nearer to one sealing surface than the other. Filler material to add weight to the device may be added internally, and a pair of internal reinforcement means may be utilized to envelope or retain the filler material to prevent its migration to either of the sealing surfaces.

DETAILED DESCRIPTION OF THE INVENTION

With reference to the drawings, the invention will now be described in detail with regard for the best mode and the preferred embodiment. In general, the invention is a drain sealing device comprising a mat or sheet-like device having a relatively thin vertical dimension as compared to its horizontal dimensions. The perimeter or edge configuration of the drain sealing device may be rectangular, square, round, oblong or any other desired shape. The invention is preferably composed of a polymeric material such as a polyurethane, PVC, silicone, or other similar polymers or blends which have suitable properties and characteristics as discussed below, and in particular which are liquid impermeable, resistant to chemical degradation or other types of exposure degradation, non-hazardous, durable and flexible. The drain seal device is utilized by placing it directly on top of a drain grate such that all apertures in the drain grate are covered by the invention.

Figure 1:
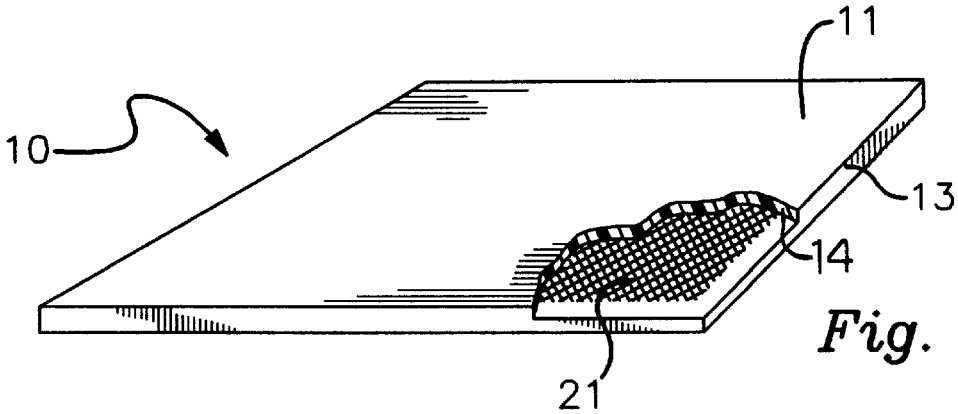
FIG. 1 is a partially exposed perspective view of the drain sealing device comprising the invention showing the internal reinforcement means.
Figure 2:
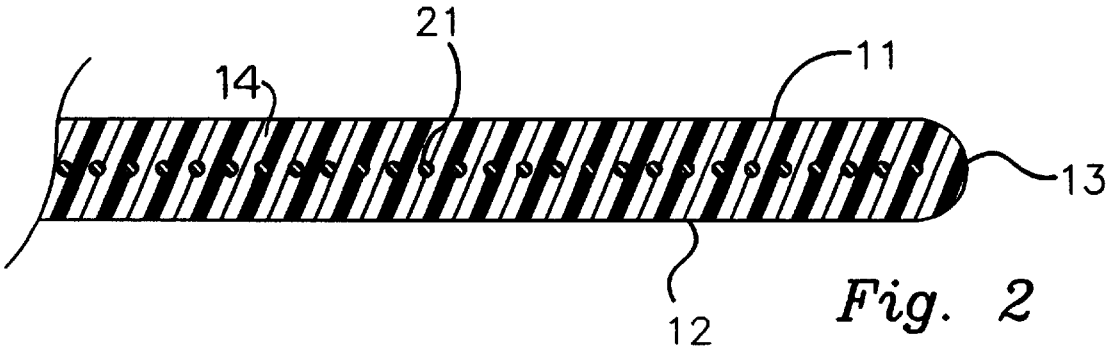
FIG. 2 is a partial cross-sectional view of an alternative embodiment of the invention showing the preferred rounded edge.
Figure 3:
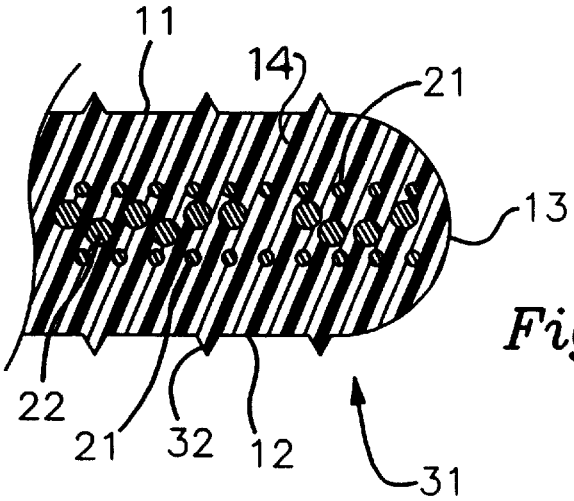
FIG. 3 is a partial cross-sectional view of an alternative embodiment of the invention, where a pair of reinforcement means are provided to entrap weighted filler material, and where the outer sealing surfaces are provided with externally extending ridge members.
Figure 4:
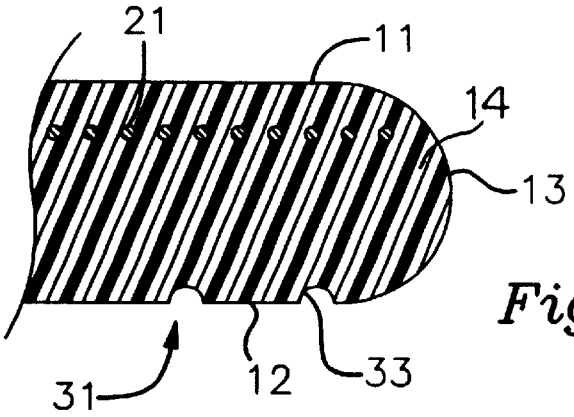
FIG. 4 is a partial cross-sectional view of an alternative embodiment of the invention, where the reinforcement means is not centered and one outer sealing surface is provided with internally extending channel members.
Figure 5:
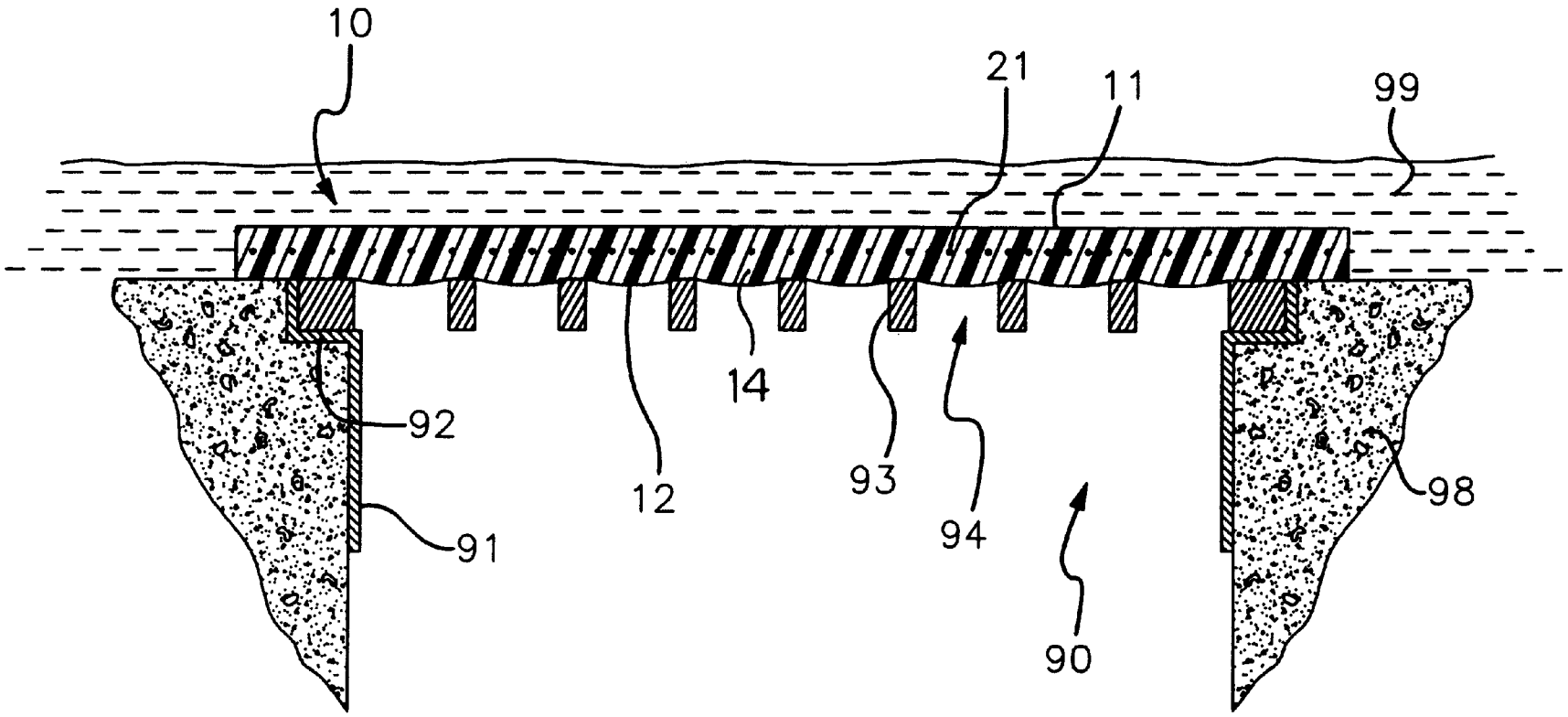
FIG. 5 is a cross-sectional view of the invention showing it in use to block a storm drain grate and showing the bottom of the invention sagging into the grate apertures to maximize the sealing effects.

As shown in FIG. 1, the invention comprises a drain seal device 10 in the form of a mat having a pair of generally planar, opposing, sealing surfaces 11 and 12, an exterior perimeter edge 13 bounding said sealing surfaces 11 and 12, and at least one internal reinforcement means 21 disposed between said sealing surfaces 11 and 12. Preferably, the drain seal 10 is formed of a single polymer or polymer blend material, such that sealing surfaces 11 and 12 are of the same composition and therefore provide identical sealing properties. The internal reinforcement means 21 is disposed within the body 14 of the drain seal 10 such that the internal reinforcement means 21 is completely enclosed or encased within the seal device 10 and does not contact, is not formed as a part of and does not protrude through either of the sealing surfaces 11 and 12, although the internal reinforcement means 21 may extend to the perimeter edge 13. Perimeter edge 13 may be generally planar and disposed at right angles to the sealing surfaces 11 and 12 as shown in FIGS. 1 and 5, but is preferably rounded as shown in FIGS. 2 through 4. The rounded configuration for the perimeter edge 13 is better suited to preclude forced ingress of water or other liquids beneath the perimeter edge 13, which could result in failure of the seal due to the water lifting the sealing device 10, since the rounded configuration places more weight at the outermost point and provides a curved upper surface over which water flows more easily without the inherent lift effects of the right angle edges presented by the planar configuration of FIGS. 1 and 5. Other configurations for the perimeter edge 13, such as a sloping or beveled configuration, would also be suitable.

The internal reinforcement means 21 may be composed of any suitable material which increases the tear resistance, strength and rigidity of the drain seal 10, but which allows the drain seal 10 to retain the necessary creep, sag and flexibility characteristics necessary to effectively seal the apertures 94 in a drain grate 93. Preferably, the internal reinforcement means 21 comprises a fiberglass scrim, a fabric, a mesh, a flexible FRP screen, a formable metal wire screen or other such member which extends in generally planar fashion in the two horizontal dimensions. Alternatively, a layer of non-woven or disconnected reinforcing material, such as for example glass, carbon or polymer fibers or cords, or aggregate filler material, may be utilized as the internal reinforcing means 21. Still alternatively, the reinforcing means 21 may comprise an internally disposed layer of higher strength, higher durometer, more rigid polymer material in comparison to the polymer material composing the sealing surfaces 11 and 12. Also preferably the internal reinforcement means 21 extends generally co-extensively and generally co-planarly with the two sealing surfaces 11 and 12. The internal reinforcement means 21 is preferably disposed centrally between the sealing surfaces 11 and 12, but may be disposed nearer to one of the sealing surfaces 11 and 12 as shown in FIG. 4. Such a non-central disposition may be utilized for example if slightly different creep, sag or flexibility characteristics for the two sealing surfaces 11 and 12 is desired.

It is also possible to add additional filler material 22 within the drain seal 10, as shown in FIG. 3, where it is desirable to increase the weight of the drain seal 10 or to alter other characteristics of the overall drain seal 10. For example, small pellets, sand, pebbles, metal shot or the like could be provided to add weight to: the drain seal 10. This may be useful since the provision of internal reinforcement means 21 allows the overall height or vertical dimension of the drain seal 10 to be relatively small, especially in comparison to known devices which utilize additional polymer layers to increase structural properties, making it more susceptible to be displaced by strong wind gusts. In a most preferred configuration, any filler material 22 is disposed between two layers of internal reinforcement means 21, as shown in FIG. 3. The two layers of internal reinforcement means 21 encase or envelope the filler material 22, thereby preventing the filler material 22 from migrating to either of the sealing surfaces 11 or 12.

The drain seal device 10 is utilized as shown in FIG. 5, which shows a representational drain assembly 90. The drain seal 10 is placed directly onto the drain assembly 90, which as illustrated comprises a metal drain body 91 having a shoulder 92 to receive a drain grate 93 having apertures 94 for liquid passage. The drain body 91 and grate 93 are shown disposed within a concrete slab 98, which could be part of the floor of a building, a parking lot, a road, etc. The drain seal 10 is disposed such that one of the sealing surfaces 11 or 12 directly contacts the drain grate 93, and the size of the drain seal 100 is such that the perimeter edge 13 extends beyond all sides of the grate 93. The sealing effect of the drain seal 10 thereby prevents passage of water 99 through the drain assembly 90. In order to effect a proper seal to completely close off the drain apertures 94, it is necessary that the drain seal 10 polymer composition possess a minimum amount of creep, sag, compressibility and flexibility, such that the sealing surface 11 or 12 in contact with the grate 93 will slightly deform within the apertures 94 and the sealing surface 11 or 12 in contact with the concrete slab 98 will slightly deform to surface variations in the slab 98 to provide a complete seal. For example, when the sealing drain 10 is placed across a three inch wide opening, it is preferable that the lower sealing surface 11 or 12 sag at least one sixteenth of an inch. Likewise, when the drain seal 10 is disposed on a three quarter inch high raised shoulder above a planar base surface, it is preferable that the lower sealing surface 11 or 12 contact the base surface within three inches of the shoulder. In addition, while the sealing surfaces 11 and 12 may be slightly tacky, it is preferable that this be minimized such that the surfaces 11 and 12 can be stored without extra precautions, such as removable cover layers, to prevent adhesion to other sealing devices 10 or other objects and to minimize adhesion of dirt, sand and other particulates, thereby allowing the devices 10 to be easily cleaned and reused. It is most preferable that the tackiness of the sealing surfaces 11 and 12 be such that less than four grams of 100 grit Carborundum adhere per square inch when the sealing surface 11 or 12 is contacted with a coextensive expanse of loose 100 grit Carborundum.

In alternative embodiments, as shown in FIGS. 3 and 4, at least one or more structural sealing members 31 may be provided on the sealing surfaces 11 and 12. Such structural sealing members 31 may comprise outwardly extending ridge members 32 or inwardly extending channel members 33. The structural sealing members 31 serve to increase the sealing efficacy of the drain seal 10.

It is contemplated that equivalents and substitutions to certain elements set forth above may be obvious to those skilled in the art, and thus the true scope and definition of the invention is to be as set forth in the following claims.

We claim:

1. A drain seal mat comprising a body, a pair of opposing sealing surfaces capable of forming a liquid impermeable seal when disposed onto a drain grate, and a perimeter edge bounding said sealing surfaces, said body, said sealing surfaces and said perimeter edge all composed of a single liquid impermeable polymer material, said mat further comprising internal reinforcement means disposed within said body between said sealing surfaces, wherein said internal reinforcement means comprises an apertured mesh integrally embedded within said liquid impermeable polymer material.

2. The mat of claim 1, wherein said internal reinforcement means comprises a material chosen from the group of materials consisting of fiberglass scrim, fabric, mesh, fiber reinforced plastic (FRP) screen, wire screen, and polymers of higher rigidity than said sealing surfaces.

3. The mat of claim 1, wherein said internal reinforcement means does not contact either of said sealing surfaces.

4. The mat of claim 1, wherein said internal reinforcement means is centrally disposed between said sealing surfaces.

5. The mat of claim 1, wherein said internal reinforcement means is non-centrally disposed between said sealing surfaces.

6. The mat of claim 1, wherein said perimeter edge is rounded.

7. The mat of claim 1, further comprising at least one structural sealing member disposed on at least one of said sealing surfaces.

8. The mat of claim 7, wherein said at least one structural sealing member comprises outwardly extending ridges.

9. The mat of claim 7, wherein said at least one structural sealing members comprises inwardly extending channels.

10. The mat of claim 1, further comprising filler material disposed between said sealing surfaces, said filler material increasing the weight of the mat without increasing the thickness.

11. The mat of claim 10, wherein said internal reinforcement means is provided in two layers, and said filler material is enveloped between said two layers of said internal reinforcement means.

12. The mat of claim 1, wherein said internal reinforcement means is generally coextensive and co-planar with said sealing surfaces.

13. The mat of claim 1, wherein said device has a flexibility characterized in that said device will sag at least one sixteenth of an inch when disposed across a three inch opening, and further wherein said device will contact a base surface within three inches when disposed across a raised shoulder three quarter inches above said base surface.

14. The mat of claim 1, wherein said sealing surfaces are characterized in that less than 4 grams of 100 grit Carborundum adhere per square inch when said sealing surfaces are contacted with a coextensive expanse of loose 100 grit Carborundum.

15. A drain seal device for preventing liquid ingress into a drain assembly having an apertured grate, said drain seal device being a flexible mat comprising a body, a pair of generally planar, opposing, sealing surfaces adapted to abut such apertured grate in sealing manner, and a perimeter edge bounding said sealing surfaces and adapted to extend beyond such apertured grate, said body, said sealing surfaces and said perimeter edge all composed of a single liquid impermeable polymer material, said device further comprising internal reinforcement means disposed within said body between said sealing surfaces which does not contact said sealing surfaces and which extends generally coextensively with said sealing surfaces, wherein said internal reinforcement means comprises an apertured mesh integrally embedded within said liquid impermeable polymer material.

16. The device of claim 15, wherein: said internal reinforcement means comprises a material chosen from the group of materials consisting of fiberglass scrim, fabric, mesh, fiber reinforced plastic (FRP) screen, wire screen and polymers of higher rigidity than said sealing surfaces.

17. The device of claim 15, wherein said internal reinforcement means is centrally disposed between said sealing surfaces.

18. The device of claim 15, wherein said internal reinforcement means is non-centrally disposed between said sealing surfaces.

19. The device of claim 15, wherein said perimeter edge is rounded.

20. The device of claim 15, further comprising at least one structural sealing member disposed on at least one of said sealing surfaces.

21. The device of claim 20, wherein said at least one structural sealing member comprises outwardly extending ridges.

22. The device of claim 20, wherein said at least one structural sealing member comprises inwardly extending channels.

23. The device of claim 15, further comprising filler material disposed between said sealing surfaces, said filler material increasing the weight of the mat without increasing the thickness.

24. The device of claim 23, wherein said internal reinforcement means is provided in two layers, and said filler material is enveloped between said two layers of said internal reinforcement means.

25. The device of claim 15, wherein said device has a flexibility characterized in that said device will sag at least one sixteenth of an inch when disposed across a three inch opening, and further wherein said device will contact a base surface within three inches when disposed across a raised shoulder three quarter inches above said base surface.

26. The device of claim 15, wherein said sealing surfaces are characterized in that less than 4 grams of 100 grit Carborundum adhere per square inch when said sealing surfaces are contacted with a coextensive expanse of loose 100 grit Carborundum.

* * * * *